US006694542B2

(12) United States Patent
Johansson

(10) Patent No.: US 6,694,542 B2
(45) Date of Patent: Feb. 24, 2004

(54) HIP BATH

(76) Inventor: Paul-Johnny Johansson, P.O. Box 508, Hinsdale, IL (US) 60522-0508

( * ) Notice: Subject to any disclaimer, the term of this patent is extended or adjusted under 35 U.S.C. 154(b) by 0 days.

(21) Appl. No.: 10/282,646

(22) Filed: Oct. 29, 2002

(65) Prior Publication Data

US 2003/0084504 A1 May 8, 2003

(30) Foreign Application Priority Data

Nov. 8, 2001 (DE) ..... 101 54 918

(51) Int. Cl.[7] ..... A47K 3/02
(52) U.S. Cl. ..... 4/555; 4/557; 4/590
(58) Field of Search ..... 4/555–557, 584, 4/590, 604, 611, 612, 567, 568, 596, 597

(56) References Cited

U.S. PATENT DOCUMENTS

D206,143 S * 11/1966 Jacuzzi ..... D24/204
3,616,467 A * 11/1971 Drain ..... 4/604
4,099,272 A * 7/1978 Sowder ..... 4/555
4,202,060 A * 5/1980 Touze ..... 4/556
4,346,485 A 8/1982 Reed et al.
4,523,341 A * 6/1985 Queen ..... 4/555
4,796,312 A * 1/1989 Corlew ..... 4/555
5,978,983 A * 11/1999 Queen et al. ..... 4/556
6,327,721 B1 * 12/2001 Devereaux et al. ..... 4/541.3
6,473,915 B1 * 11/2002 Davis et al. ..... 4/555

FOREIGN PATENT DOCUMENTS

DE 10110715 A1 9/2002

* cited by examiner

*Primary Examiner*—Gregory Huson
*Assistant Examiner*—Huyen Le
(74) *Attorney, Agent, or Firm*—Tarolli, Sundheim, Covell & Tummino L.L.P.

(57) ABSTRACT

The present invention relates to a hip bath including a rear space (1) with a seat (2) as well as a front space (3) with a door opening (5) in a front side (4) thereof, said door opening (5) being closable by a door (6), wherein the seat (2) has a seat surface (7) with a notch (8), which extends rearwardly and divides said seat surface in two portions (7*a*, 7*b*). The front space (3) has as constant or substatially constant width (VB) and the rear space (1) has a greater width (HB) than the front space (3).

15 Claims, 2 Drawing Sheets

HIP BATH

FIELD OF THE INVENTION

The present invention relates to a hip bath including a rear space with a seat as well as a front space with a door opening in a front side thereof, said door opening being closable by a door, wherein the seat has a seat surface with a notch, which is closed at the rear, extends rearwardly in the seat surface and divides said seat surface in two portions.

BACKGROUND OF THE INVENTION

At hip baths of the abovementioned type, the rear and front spaces normally have substantially the same width. Hereby, a large front space is provided, which because of its size must be filled with large amounts of water in order to reach the desired water level therein.

SUMMARY OF THE INVENTION

The object of the present invention is to eliminate this draw back without substantially affecting the access to the seat through the front space and the design of the hip bath. This is arrived at according to the invention by providing the hip bath with the characterizing features of primarily subsequent claim 1.

Due to the narrower design or shaping of the front space than the rear space and due to the equally wide or substantially equally wide design of the front space, it is achieved that the front space is smaller and thus, may be filled with less water in order to reach a desired water level than if the front space has the same width as the rear space. Additionally, neither the access to the seat through the front space nor the design or shaping of the hip bath need to be negatively affected.

BRIEF DESCRIPTION OF THE DRAWINGS

The invention will be further described below with reference to the accompanying drawings, in which.

DETAILED DESCRIPTION OF THE INVENTION

Figure 1:
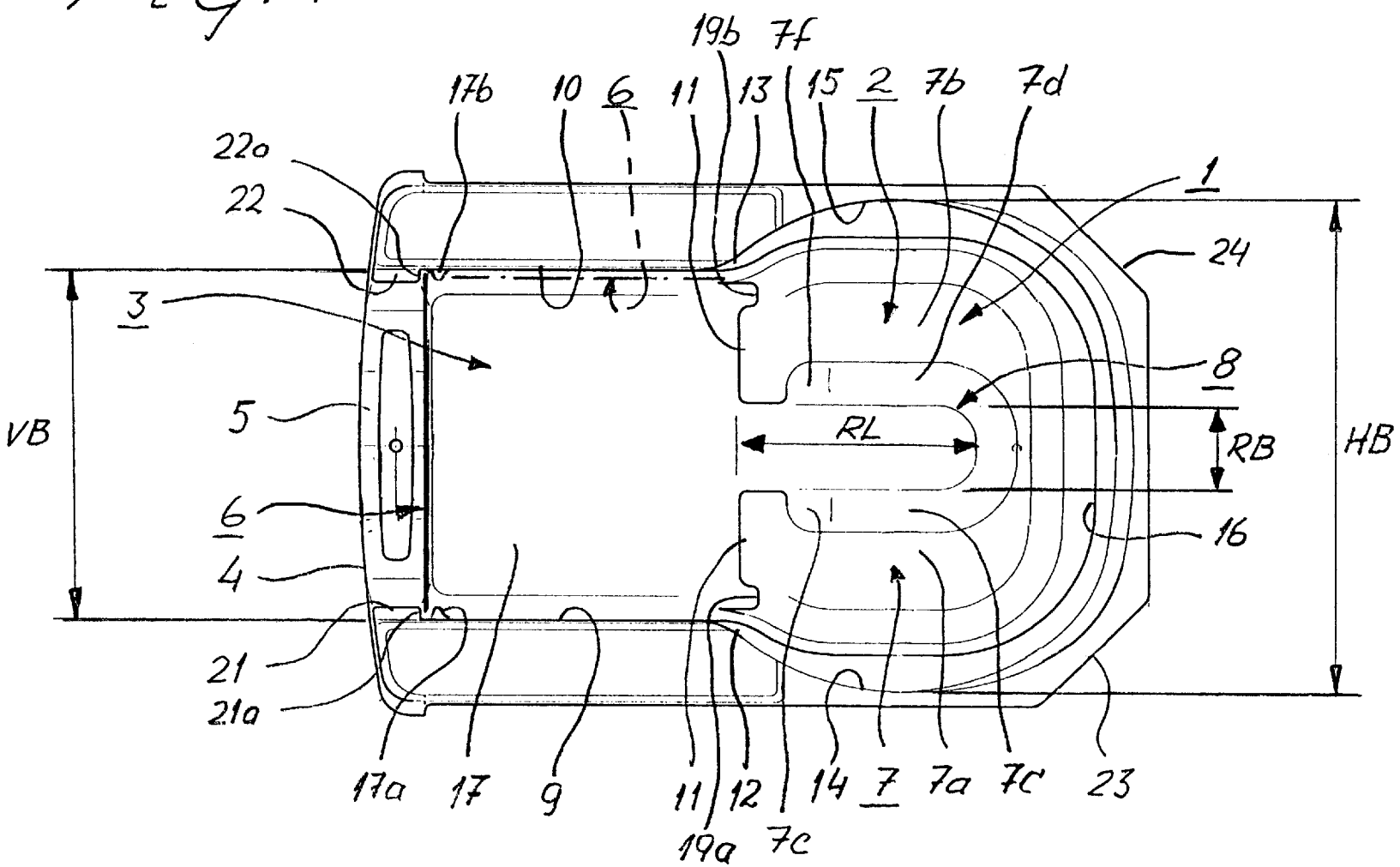
FIG. 1 is a top plan view of a hip bath according to the invention.
Figure 2:
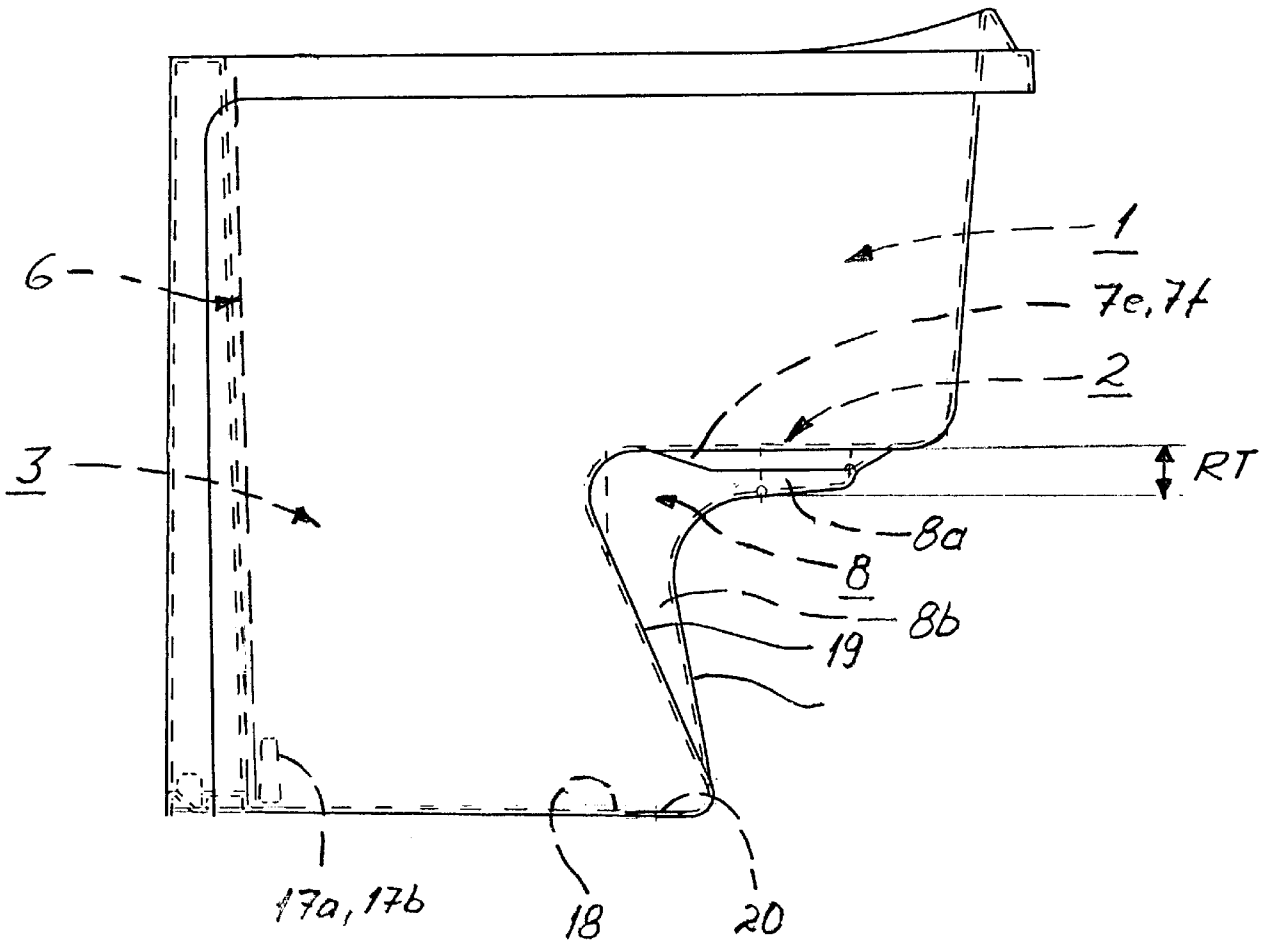
FIG. 2 is a side view of the hip bath of FIG. 1.

The hip bath according to FIGS. 1 and 2 has a rear space 1 with a seat 2 and a front space 3 with a door opening 5 in a front side 4. This door opening 5 may be closed by a door 6. The seat 2 has a seat or sitting surface 7 with a notch 8 which is open at the front and upwards, closed at the rear, extends rearwardly in the seat surface 7 and divides said seat surface in two portions 7*a*, 7*b*.

The notch 8 has such a width RB, length RL and depth RT that one may insert a hand and/or a washing device into said notch from the front and/or from above for washing the lower abdomen of a person sitting on the seat 2. This can be done by the person him- or herself or by personnel if the person is unable to perform said washing. The washing device may be a shower nozzle for showering the lower abdomen.

The front space 3 has an unchanged or constant width VB or a substantially unchanged or constant width VB and the rear space 1 has a larger width HB than the front space 3, i.e. the front space 3 is narrower than the rear space 1.

Due to this shape of the front space 3, the inner size thereof is reduced relative to the inner size of the rear space 1, whereby, when filling the hip bath to a certain water level, it is possible to fill it with less water than otherwise necessary.

The narrower front space 3 may have opposite side walls 9, 10 which from above are straight or substantially straight and which may be vertical or substantially vertical. Also, the side walls 9, 10 may extend to about front portions 11 of the seat 2 and here transform into diverging wall portions 12, 13 which in turn transform into side walls 14, 15 of the rear space 1.

The side walls 14, 15 and a rear wall 16 of the rear space 1 define a space which from above is at least partly round.

The rear and front spaces 1 and 3 may together, seen from above, define a keyhole shaped double space.

The front space 3 has a bottom 17 and the seat 2 define an at least partly higher situated lower side of the rear space 1 than said bottom 17. The front portions 11 of the seat 2 and rear portions 18 of the bottom 17 are joined together preferably by a lower wall 19. This lower wall 19 may extend obliquely downwards and backwards from the front portions 11 of the seat 2 such that the rear portions 18 of the bottom 17 are located underneath the front portions 11 of the seat 2. Hereby, a person to be seated or sitting on the seat 2 may put his or her feet on the rear portions 18 of the bottom 17 and the person can thereby be seated easier or stand up easier.

The notch 8 may include an upper part 8*a* which is provided in the seat 2 and a lower part 8*b* which is connected to the upper part 8*a* and provided in the lower wall 19 and which extends downwards therein. Hereby, water from the upper part 8*a* of the notch 8 can flow into the lower part 8*b* and through said lower part 8*b* down to the bottom 17 and through an outlet 20 at said bottom 17.

The lower wall 19 may have vertical recesses 19*a*, 19*b* which are provided on opposite sides of the lower part 8*b* of the notch 8. By means of these recesses 19*a*, 19*b* water from the seat 2 may flow downwards beside the notch 8.

The seat 2, the bottom 17, the lower wall 19, the walls 9, 10, 12, 13, 14, 15, 16 and front wall portions 21, 22 which define the door opening 5, are preferably formed in one piece of plastic material. This piece of plastic material may also include outer walls and other parts of the hip bath.

The notch 8 may have such a width RB, length RL and depth RT that a hand and/or washing device, e.g. a shower nozzle, may be inserted into said notch 8 from the front and/or from above. Hereby, a person sitting on the seat 2 can wash his or her lower abdomen or can the lower abdomen of a person sitting on the seat 2 be washed by personnel.

The two portions 7*a*, 7*b* of the seat 2 may transform into the notch 8 through inclined edge surfaces 7*c*, 7*d* which extend obliquely towards the notch 8.

These inclined or oblique edge surfaces 7*c*, 7*d* may at the front connect to the front portions 11 of the seat 2 through obliquely upwards extending surfaces 7*e*, 7*f*. These obliquely upwards extending surfaces 7*e*, 7*f* prevent or counteract unintentional forward slipping or gliding from the seat 2 of a person sitting thereon.

The door 6 may be a separate door leaf which can be removed from the hip bath. This door leaf 6 may be flat and transparent. The door leaf can be pushed from above to a closing position behind inner edges 21*a*, 22*a* of the front wall portions 21, 22 and in front of lower elevations or raises 17*a*, 17*b* in the front space 3, and can then be pulled upwards again for opening up the door opening. The door leaf may have such a size and shape that it can be placed in the front space 3 and thereby at one of the two side walls 9, 10, e.g. at the side wall 10 and in parallel therewith as shown with the broken line in FIG. 1. The front space 3 may include brackets (not shown) for holding the door 6 close to the side wall 10.

The hip bath may have, at two rear corners, inclined wall portions 23, 24 which extend perpendicular or substantially perpendicular relative to each other, so that the hip bath can be placed in a corner of a room, whereby the inclined wall portions 23, 24 extend in parallel or substantially in parallel with two walls of that room.

The invention may be modified within the scope of the subsequent claims. The rear and front spaces 1, 3 may e.g. have the same or substantially the same length, the lower wall 19 may extend vertically instead of obliquely backwards and the notch 8 may extend along the major part of the seat 2. The door leaf 6 may have an opening (not shown) at the top for engagement when lifting the door leaf. The hip bath may include one or more water taps and a shower device. Instead of a separate door leaf 6, a door can be used, which on one side is suspended on the hip bath and which is pivotable into the hip bath for opening up the door opening. A door leaf 6 or a pivotable door will keep the space in front of the hip bath clear, but eventually, a suspended door can be used which swings or pivots in outwards direction.

What is claimed is:

1. A hip bath comprising a rear space (1) with a seat (2) as well as a front space (3) with door opening (5) in a front side (4) thereof, said seat (2) having a seat surface (7) with a notch (8), which extends rearwardly and divides said seat surface (7) in two portions (7*a*, 7*b*), characterized in that the front space (3) has a constant or substantially constant width (VB) and that the rear space (1) has a greater width (HB) than the front space (3), said hip bath further characterized in that the rear space (1), as seen from above, has an arcuate perimeter and the front space (3), as seen from above, has a rectangular perimeter.

2. The hip bath according to claim 1, characterized in that the front space (3) has a constant or substantially constant width (VB) and is narrower than the rear space (1) in order to reduce the inner size of the front space (3) relative to the inner size of the rear space (1) and thereby, when filing the hip bath with bathing water to a certain water level, being able to fill said hip bath with less water than otherwise necessary.

3. The hip bath according to claim 1, characterized in that the front space (3) has opposite side walls (9, 10) which, seen from above, are straight or substantially straight, that said side walls (9, 10) are vertical or substantially vertical and that said side walls (9, 10) extend to about front portions (11) of the seat (2) and here transform into diverging wall portions (12, 13) which in turn transform into side walls of the rear space (1).

4. The hip bath according to claim 1, characterized in that side walls (14, 15) and a rear wall (16) of the rear space (1) define, seen from above, an at least partly round space.

5. The hip bath according to claim 1, characterized in that the rear and front spaces (1 and 3), seen from above, define a keyhole shaped space.

6. The hip bath according to claim 1, characterized in that the notch (8) is open at the front and upwards and that the width (RB), length (RL) and depth (RT) of the notch (8) is selected so that a hand and/or a washing device, e.g. a shower nozzle, may be inserted into said notch (8) from the from and/or from above, such that a person sitting on the seat (2) can wash his or her lower abdomen or that the lower abdomen of a person sitting on the seat (2) can be washed by personnel.

7. The hip bath according to claim 1, characterized in that the door (6) consists of a separate door leaf (6) which can be removed from a position closing the door opening (5) and from the hip bath or swung or pivoted inwards into said hip bath.

8. The hip bath according to claim 1, characterized in that the door (6) can be placed in the front space (3) in parallel or substantially in parallel with a side wall (9 or 10) of the front space (3) and close to said side wall (9 or 10).

9. The hip bath according to claim 1, characterized in that the hip bath at two rear edges have inclined or oblique wall portions (23, 24) which extend perpendicular or substantially perpendicular relative to each other so that the hip bath can be placed in a corner of a room, whereby the inclined wall portions (23, 24) extend in parallel or substantially in parallel with two walls of said room.

10. A hip bath comprising a rear space (1) with a seat (2) as well as a front space (3) with a door opening (5) in a front side (4) thereof, seat (2) having a seat surface (7) with a notch (8), which extends rearwardly and divides said seat surface (7) in two portions (7*a*, 7*b*), characterized in that the front space (3) has a constant or substantially constant width (VB) and that the rear space (1) has a greater width (HB) than the front space (3), said hip bath further characterized in that two portions (7*a*, 7*b*) of the seat (2) which are situated on opposite sides of the notch (8), transform into the notch (8) through inclined edge surfaces (7*c*, 7*d*) which extend obliquely downwards toward the notch (8) and that said oblique or inclined edge surfaces (7*c*, 7*d*) are connected to front portions (11) of the seat (2) through obliquely upwards extending surfaces (7*e*, 7*f*), which have such shape that they prevent or counteract unintentional forward slipping or gliding from the seat (2) of a person sitting thereon.

11. The hip bath according to claim 1, characterized in that the front space (3) has a bottom (17), that the seat (2) define an at least partly higher situated lower side of the rear space (1) than said bottom (17) and that a front portion (11) of the seat (2) and rear portions (18) of the bottom (17) are joined together by a lower wall (19).

12. The hip bath according to claim 11, characterized in that the lower wall (19) extends obliquely downwards and backwards from the front portion (11) of the seat (2) and rear portions (18) of the bottom (17) are located underneath the front portion (11) of the seat (2), whereby a person to be seated or sitting on the seat (2) can put his or her feet on the rear portions (18) of the bottom (17) beneath the front portion (11) of the seat (2).

13. The hip bath according to claim 11, characterized in that the notch (8) has an upper part (8*a*) which is provided in the seat (2) and a lower part (8*b*) which is connected to the upper part (8*a*) and provided in the lower wall (19) and which extends downwards therein.

14. The hip bath according to claim 11, characterized in that at least the seat (2), the bottom (17), the lower wall (19) and the walls (9, 10, 12, 13, 14, 15 and 16) of the hip bath, which define the rear and front space (1, 3), are made up of one piece of plastic material.

15. A hip bath comprising a rear space (1) with a seat (2) as well as a front space (3) with a door opening (5) in a front side (4) thereof, seat (2) having a seat surface (7) with a notch (8), which extends rearwardly and divides said surface (7) in two portions (7*a*, 7*b*), characteized in that the front space (3) has a constant or substantially constant width (VB) and that the rear space (1) has a greater width (HB) than the front space (3), the front space (3) has a bottom (17), that the seat (2) define an at least partly higher situated lower side of the rear space (1) than said bottom (17) and that a front portion (11) of the seat (2) and rear portions (18) of the bottom (17) are joined together by a lower wall (19), said hip bath further characterized in that the lower wall (19) have vertical recessed (19*a*, 19*b*) which are provided on opposite sides of the lower part (8*b*) of the notch (8).

* * * * *